United States Patent [19]

Guiffray

[11] Patent Number: 4,642,972

[45] Date of Patent: Feb. 17, 1987

[54] METHOD FOR MANUFACTURING CONTAINERS OF A FLEXIBLE OR SEMI-RIGID MATERIAL AND HAVING AN ELONGATED NECK, AND CONTAINERS MANUFACTURED BY SAID METHOD

[76] Inventor: Michel Guiffray, 136 Rue Vulfran Warmé80000 Amiens, France

[21] Appl. No.: 687,445

[22] Filed: Dec. 28, 1984

[30] Foreign Application Priority Data

Dec. 30, 1983 [FR] France ..... 83 21117

[51] Int. Cl.[4] ..... B65B 47/00

[52] U.S. Cl. ..... 53/453

[58] Field of Search ..... 53/452, 453, 455, 456, 53/559, 562, 382; 206/538, 820

[56] References Cited

U.S. PATENT DOCUMENTS

| | | | |
|---|---|---|---|
| 2,472,440 | 6/1949 | Salfisberg | 53/559 X |
| 2,705,579 | 4/1955 | Mason | 53/443 X |
| 3,245,197 | 4/1966 | Van Mil | 53/453 |
| 3,497,059 | 2/1970 | Watts | 53/453 X |
| 3,596,428 | 8/1971 | Young et al. | 53/455 X |
| 3,782,066 | 1/1974 | Schmitt . | |
| 3,975,885 | 8/1976 | Carlisle | 53/452 |
| 4,254,871 | 3/1981 | Poore | 206/820 X |
| 4,384,440 | 5/1983 | Ohlsson | 53/456 X |

FOREIGN PATENT DOCUMENTS

| | | | |
|---|---|---|---|
| 2312800 | 9/1974 | Fed. Rep. of Germany | 53/453 |
| 1169093 | 12/1958 | France . | |
| 2540072 | 3/1984 | France . | |

*Primary Examiner*—John Sipos
*Assistant Examiner*—Steven P. Weihrouch
*Attorney, Agent, or Firm*—Cushman, Darby & Cushman

[57] ABSTRACT

Method for manufacturing and filling containers of flexible or semi-rigid material having an elongated neck for receiving liquid, pasty or powdered products such as maintenance products, carried out in a production line in which the containers are formed one after the other from two sheets (1) in which are moulded complementary semi-shells (2) which are assembled along parallel edges; there are formed on each lateral edge of each semi-shell (2) at least two rectilinear sections (*6a, 7a; 6b, 7b*) arranged in a broken line so that each rectilinear section of one edge is parallel to one of the rectilinear sections of the opposite edge of the same semi-shell (2) and at the same time offset relative to said other section along a general axis (X—X) of the semi-shell (2), and there are formed on each sheet (1) the semi-shells (2) in head-to-toe relation to each other and the container is filled through a gap left free between two upper rectilinear sections. This method economizes a large amount of material.

3 Claims, 5 Drawing Figures

METHOD FOR MANUFACTURING CONTAINERS OF A FLEXIBLE OR SEMI-RIGID MATERIAL AND HAVING AN ELONGATED NECK, AND CONTAINERS MANUFACTURED BY SAID METHOD

The present invention relates to a method for manufacturing and filling containers of a flexible or semi-rigid material having a structure which is for example symmetrical relative to a central axis and an elongated neck, for receiving liquid, pasty or powdered products such as maintenance products, chemical products, etc . . . and the containers obtained by said method.

In a general way, the invention is applicable to the manufacture of containers which are or are not symmetrical and comprise two semi-shells assembled along parallel edges.

The containers of flexible material usually employed for various types of liquid, such as the aforementioned liquids, usually have a bottle shape and are manufactured on production lines from two sheets of plastics material in which complementary semi-shells are moulded, said shells being thereafter assembled along their longitudinal junction plane by welding. These bottles, when placed vertically with the neck lowermost, are filled from the bottom which is thereafter closed by welding.

The semi-shells are moulded parallel to one another, so that the corresponding containers obtained are also parallel to one another. But when these containers have a neck of appreciable length relative to their body, this parallel arrangement of the semi-shells results in a considerable loss of material since the material of the sheets located between the successive necks is not used and this very substantially increases the cost of the bottles thus obtained.

An object of the invention is to provide a method for manufacturing and filling which reduces to a minimum the loss of material in the sheets and consequently decreases the cost of the containers.

According to the invention, the semi-shells are moulded on each sheet or semi-sheet in head-to-toe relation to each other so as to imbricate them in pairs and the filling is effected between two upper edges which are parallel and contiguous and are thereafter welded.

According to a manner of carrying out the invention applied to the manufacture of containers which are symmetrical relative to an axis, there are formed, on each lateral edge of the semi-shell, located between the neck and the bottom, at least two rectilinear sections in a broken line so that each rectilinear section of an edge of one semi-shell is parallel to one of the rectilinear sections of the opposite edge this same semi-shell and at the same time offset relative to this other section along the general axis of the semi-shell and consequently of the container, and these semi-shells arranged in head-to-toe relation to each other are formed on each sheet with their axes of symmetry parallel to one another.

The filling of the container is carried out by gravity, its median longitudinal plane being in a vertical position and one of the two rectilinear sections of each of the semi-shells being disposed horizontally in the upper part of its periphery.

As the two semi-shells of each container are assembled along their periphery by welding, a feature of the method according to the invention provides for a gap left free between the two upper horizontal rectilinear sections in confronting relation which permits carrying out the filling of the container through this gap, after which these two sections are welded together so as to close the container.

It will be understood that, under these conditions, the loss of material is considerably reduced since, owing to the head-to-toe arrangement of the semi-shells, the distance between two contiguous necks is brought to a minimum.

In the case where the manufacturing line is horizontal, i.e. the sheets are fed horizontally, the invention provides for the fact that the successive semi-shells of each sheet are inclined relative to the horizontal axis of the feed and disposed in head-to-toe relation to one another with alternating inclinations, one of the upper two rectilinear sections of each of the semi-shells being disposed horizontally.

The container, to which the invention also relates, made from a flexible or semi-rigid material, comprises a body and an elongated neck formed by the assembly of two complementary semi-shells.

According to the invention, this container comprises in its longitudinal median plane and on each side of the body, at least two rectilinear sections in a broken line, the sections of each side being adapted relative to the sections of the opposed side in such manner that each rectilinear section of one side is parallel to one of the rectilinear sections of the opposite side and offset relative to said second section along the longitudinal axis of the container.

Further features and advantages of the invention will be apparent from the following description with reference to the accompanying drawings which illustrate four embodiments by way of non-limiting examples. In the drawings.

Figure 1:
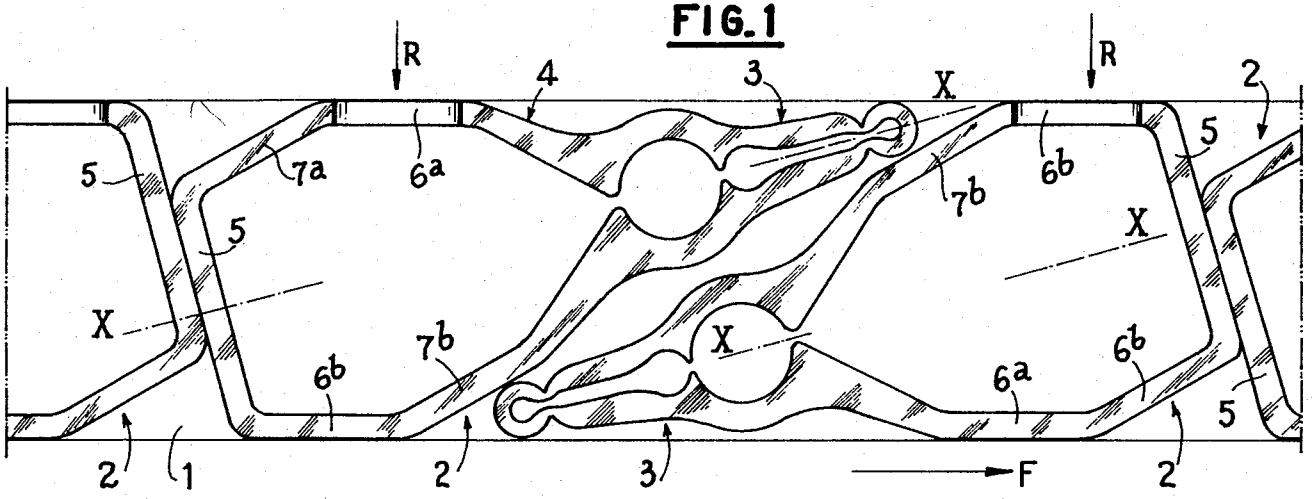
FIG. 1 is a longitudinal elevational view of a flexible or semi-rigid sheet in which have been formed semi-shells according to the invention, and which is adapted to be assembled with a complementary sheet which is symmetrical relative to the first mentioned sheet relative to their junction plane.

With reference to FIG. 1, there is shown a sheet 1 made from a flexible or semi-rigid material of suitable type, such as a plastics material, and disposed in a vertical plane and in which are moulded a succession of similar semi-shells 2 adapted to be assembled with other complementary semi-shells formed in a second sheet (not shown).

Each semi-shell 2 comprises an elongated semi-neck 3, a body 4 and a bottom 5, the general shape of the semi-shells 2 being, for example, according to that described in the French patent application No. 83 01359 of Jan. 28, 1983.

According to the invention, there are formed, on each lateral edge of each semi-shell 2, located between the neck 3 and the bottom 5, two rectilinear sections (6*a*, 7*a*; 6*b*, 7*b*) in a broken line so that each rectilinear section 6*a*, 7*a* of one edge of a semi-shell 2 is parallel to one of the corresponding rectilinear sections 6*b*, 7*b* of the opposite edge of this same semi-shell 2 and, at the same time, offset relative to this other section along a general axis X—X of the semi-shell 2 and consequently of the container obtained by assembly of two complementary semi-shells 2 along their periphery.

Thus, it can be seen in the example shown in FIG. 1 that the upper rectilinear section 6*a* adjacent to the upper edge of the sheet 1 which is fed in the horizontal direction, is parallel to the lower section 6*b* and longitudinally offset relative to the latter, i.e. both along the axis X—X and along the general direction of feed F of the sheet.

Additionally, the semi-shells 2 are formed on each sheet 1 in head-to-toe relationship to one another so that the necks 3 of a pair of semi-shells 2 are contiguous and the longitudinal axes X—X of the semi-shells 2 of this pair are parallel to each other and inclined relative to the general direction F of feed of the sheet 1. The bottoms 5 of two semi-shells 2 thus disposed in head-to-toe relation are directly adjacent to the bottom 5 of the neighboring semi-shells 2, each of the latter being disposed in head-to-toe relation to another semi-shell, such as the two semi-shells 2 shown entirely in FIG. 1, and so on along the sheet 1.

In order to form complete containers from two sheets 1 thus produced and moving for example in the direction F, the two sheets 1 are brought together in such manner that the peripheries of the respective complementary semi-shells are applied against each other and the assembly of these semi-shells is welded in the known manner (not shown), except however for horizontal upper sections 6*a*, 6*b*. Indeed, a gap is left between the sections through which the containers are filled, as indicated by the arrows R in FIG. 1. After this operation, these corresponding sections are also assembled by welding so as to close the containers which are symmetrical relative to their axis X—X.

Figures 2, 5:
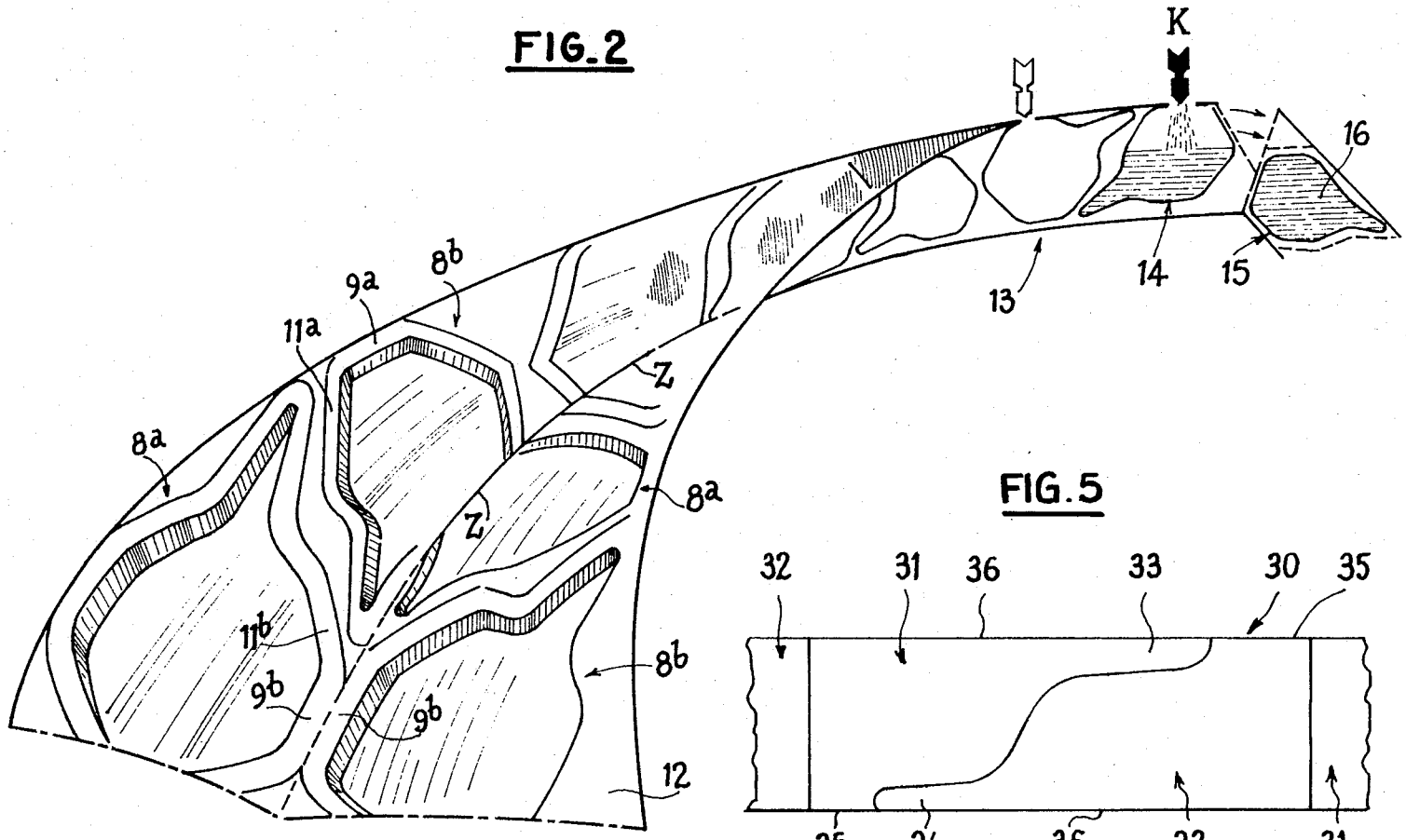
FIG. 2 is a perspective view of two sheets in which are formed complementary semi-shells before assembly and after assembly, according to a second manner of carrying out the method according to the invention.
FIG. 5 is a diagrammatic view illustrating the most general application of the invention to the manufacture of containers assembled along parallel edges.

The method of assembly of the semi-shells is diagrammatically illustrated in FIG. 2 which show conjugate semi-shells 8*a*, 8*b* having a general geometrical contour different from that of the semi-shells 2 but having, in the same way as the latter, two rectilinear sections on each of their edges, namely on one side two sections 9*a*, 11*a* and on the opposite side two sections 9*b*, 11*b*. Further, in the manner of carrying the invention shown in FIG. 2, the semi-shells 8*a*, 8*b* are formed not in two distinct sheets, but in a single sheet 12 which is folded in two along its median longitudinal axis Z—Z. After welding the semi-shells 8*a*, 8*b* at the welding station 13, except for the sections 9*a* of two complementary semi-shells, each container 14 obtained is filled, as symbolically represented by the arrow K and then the upper sections 9*a* are welded together and the sheet is cut away as indicated by the arrows so as to separate the bottles or containers 15 filled with the liquid 16.

Figure 3:
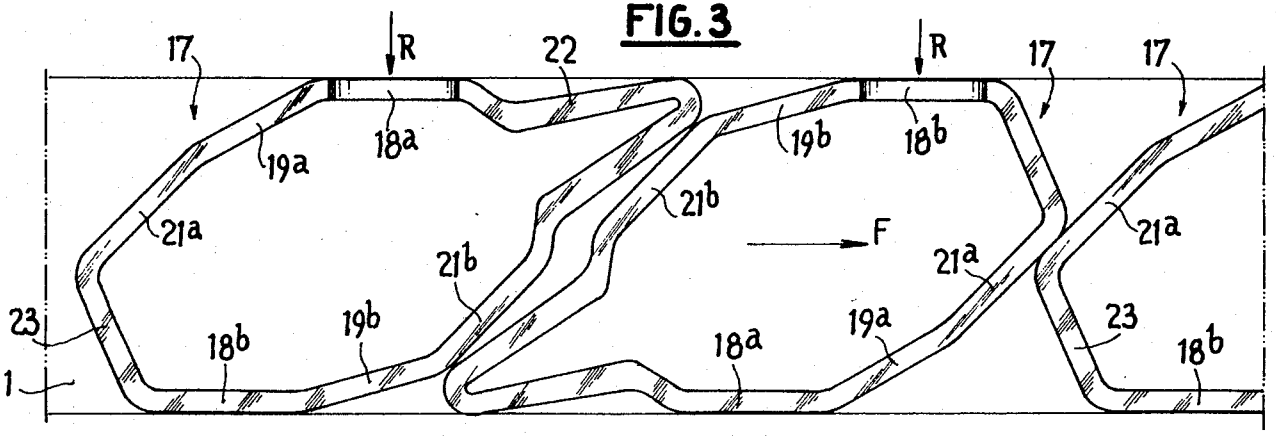
FIG. 3 is a longitudinal elevational view of a sheet in which have been formed semi-shells in accordance with a third manner of carrying out the invention.

In the modification of the manner of carrying out the invention shown in FIG. 3, each semi-shell 17 comprises edges constituted by three rectilinear sections in a broken line 18*a*, 19*a*, 21*a* and 18*b*, 19*b*, 21*b*, the upper section 18*a* being parallel to the lower opposite section 18*b* and parallel to the direction of feed F, while the sections 19*a* and 21*a*, which are inclined relative to the direction F, are respectively parallel to the sections 19*b* and 21*b*. All of these sections constitute the body of the semi-shell 17 which is completed by a neck 22 and bottom 23. The necks 22 of two consecutive pairs of semi-shells 17 are contiguous to the corresponding sections 19*b*, 21*b* which are inclined relative to the direction F, this arrangement existing in the consecutive pairs of semi-shells 17. The assembly of the latter is achieved as before, the filling being achieved by pouring the liquid between the horizontal upper sections 18*a*, 18*b* . . . (arrow R).

Figure 4:
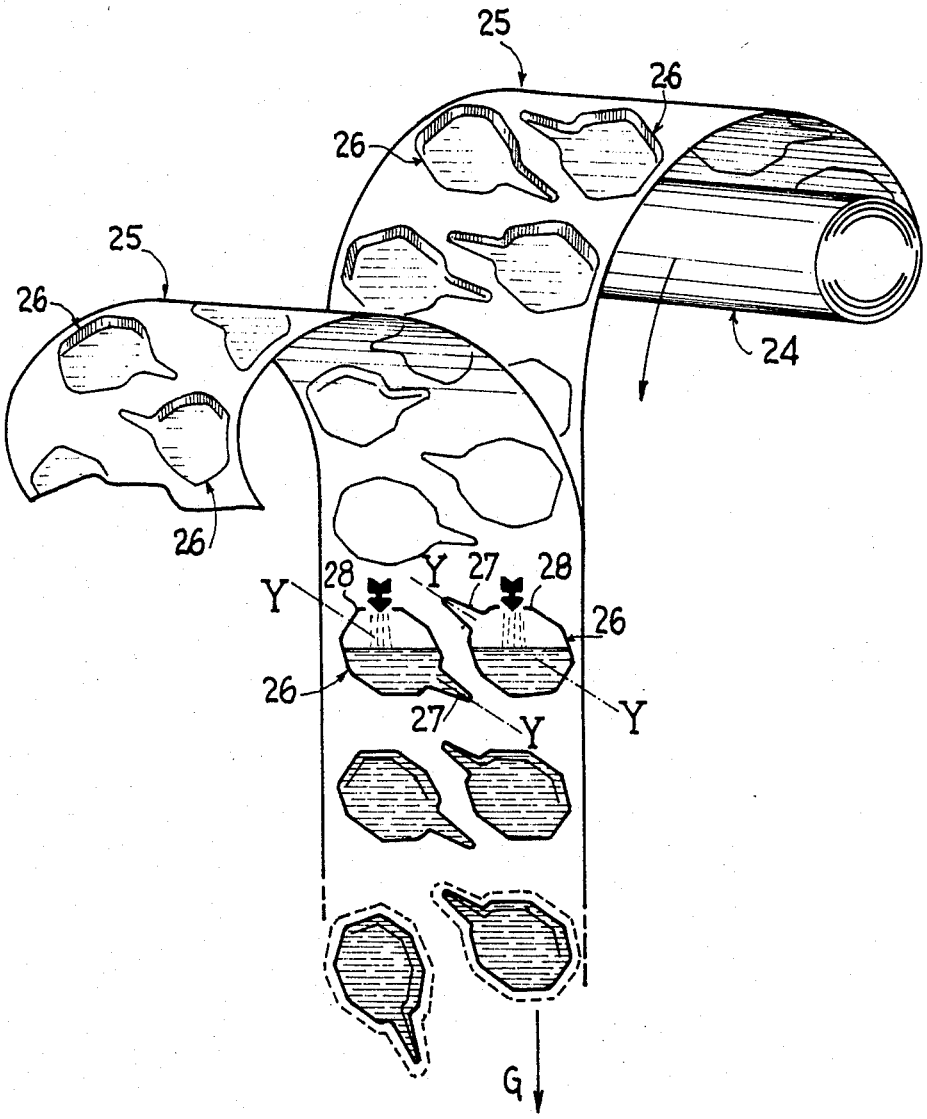
FIG. 4 is a perspective view of two sheets in which have been formed complementary semi-shells, these two sheets being unrolled in the vertical direction according to another manner of carrying out the method of the invention.

In the manner of carrying out the method shown in FIG. 4, two sheets 25 are unrolled in the vertical direction from two rolls 24. The semi-shells 26 moulded in the sheets 25 are formed with their general axis Y—Y extending transversely of the vertical direction of feed G and making with the latter an angle of about 45°. The semi-shells are disposed in head-to-toe relation in pairs in the direction of the width of each sheet 25 with their necks 27 placed one above the other.

The containers obtained after assembly of the two semi-shells 26 are filled through an opening left free between two upper and contiguous horizontal rectilinear sections 28 of two complementary semi-shells, after which these two sections are welded together so as to close the container.

In this manner of carrying out the invention, as in the foregoing manners of carrying out the invention, the head-to-toe arrangement in pairs of semi-shells permits an economy of a large amount of material relative to a conventional method.

In the manner of carrying out the method according to the invention diagrammatically shown in FIG. 5, there are formed in two sheets 30 (or in a single sheet folded in two along its longitudinal axis) containers constituted in a more general manner by two semi-shells, such as 31 and 32 having elongated necks 33, 34 respectively disposed in head-to-toe relation in pairs, one after the other.

The semi-shells 31, 32 and the complementary semi-shells (not shown) are assembled along edges 35, 36 which are parallel to each other, the filling being effected between two contiguous upper edges 35 or 36, as the case may be, which are thereafter welded. It will be observed that the consecutive semi-shells 31, 32 are closely imbricated relative to each other, which practically avoids any loss of material, and that the containers obtained from these semi-shells are not symmetrical and require only a single rectilinear section on each lateral edge of each semi-shell.

What is claimed is:

1. In a method for manufacturing and filling containers of a flexible or semi-rigid sheet material which are symmetrical relative to an axis and comprise an elongated neck, a body and a bottom, and are adapted to receive a flowing product, carried out in a production line where the containers are formed one after the other from sheet means in which sheet means are formed complementary semi-shells each symmetrical about an axis, said semi-shells being adapted to be assembled along parallel edges so as to constitute each container; the improvement comprising:

moulding the semi-shells in the sheet means in head-to-toe relation to one another so as to be imbricated in pairs, the moulding forming on each lateral edge of each semi-shell to be located between the neck and bottom of the container at least two rectilinear sections arranged in a broken line so that each rectilinear section of an edge of a semi-shell is parallel to one of the rectilinear sections of the opposite edge of said semi-shell and, at the same time, offset relative to said other section along the axis of the semi-shell and consequently of the container to be assembled therefrom, the axes of symmetry of said semi-shells moulded in said sheet means being parallel to one another;

assembling the semi-shells so as to form containers;

welding together the contiguous parallel edges of the semi-shells except for pairs of confronting contiguous rectilinear sections of those edges, extending along one edge portion of the sheet means, to leave a gap therebetween;

filling the semi-shells with a flowing product through said gaps with the sheet means positioned generally upright with said gaps at the top edge portion thereof; and welding together said pairs of edge sections to close said gaps.

2. A method according to claim 1, wherein the sheet means in which the complementary semi-shells are formed are fed horizontally and the axes of successive semi-shells of each sheet means are inclined to the direction of feed of said sheet means.

3. A method according to claim 1, wherein the sheet means comprise two sheets which are unrolled and fed in a vertical direction and the semi-shells are formed with their axes inclined to the direction of feed and disposed in pairs transversely of said direction.

* * * * *